US008459822B1

(12) United States Patent
Lambert et al.

(10) Patent No.: US 8,459,822 B1
(45) Date of Patent: Jun. 11, 2013

(54) MULTIPLE LASER SIGHTING AND ILLUMINATION SYSTEMS FOR FIREARMS

(71) Applicants: Samuel J. Lambert, Prineville, OR (US); Dennis C. Doherty, Iassaquah, WA (US); Madison J. Doherty, Iassaquah, WA (US); Gregory J. Lambert, Prineville, OR (US)

(72) Inventors: Samuel J. Lambert, Prineville, OR (US); Dennis C. Doherty, Iassaquah, WA (US); Madison J. Doherty, Iassaquah, WA (US); Gregory J. Lambert, Prineville, OR (US)

(73) Assignee: Ochoco Arms, Prineville, OR (US)

( * ) Notice: Subject to any disclaimer, the term of this patent is extended or adjusted under 35 U.S.C. 154(b) by 0 days.

(21) Appl. No.: 13/654,200

(22) Filed: Oct. 17, 2012

(51) Int. Cl.
*F41G 1/00* (2006.01)
*F41G 1/34* (2006.01)

(52) U.S. Cl.
USPC ..... 362/110; 42/114; 89/41.17

(58) Field of Classification Search
None
See application file for complete search history.

(56) References Cited

U.S. PATENT DOCUMENTS

| | | | | |
|---|---|---|---|---|
| 5,355,608 | A | 10/1994 | Teetzel | |
| 5,671,561 | A | 9/1997 | Johnson et al. | |
| 6,154,319 | A | 11/2000 | Rando et al. | |
| 6,609,815 | B1 | 8/2003 | Waibel et al. | |
| 6,986,209 | B2 | 1/2006 | Cook | |
| 7,550,725 | B2 | 6/2009 | Hollander et al. | |
| 7,726,061 | B1 * | 6/2010 | Thummel | 42/115 |
| 2006/0156560 | A1 | 7/2006 | Lines et al. | |
| 2010/0229448 | A1 | 9/2010 | Houde-Walter et al. | |

* cited by examiner

*Primary Examiner* — Britt D Hanley
(74) *Attorney, Agent, or Firm* — Leber Patent Law P.C.; Celia H. Leber

(57) ABSTRACT

Laser sighting systems for firearms are disclosed. The laser sighting systems are configured to project a peripheral pattern on a target the area of which is substantially representative of the spread of projectile(s) fired from the firearm.

20 Claims, 14 Drawing Sheets

MULTIPLE LASER SIGHTING AND ILLUMINATION SYSTEMS FOR FIREARMS

BACKGROUND

Firearm sighting systems currently exist in many forms ranging from simple open sights and aperture sights to more complex systems such as telescopic scopes with adjustable magnification. The integration of lasers into firearm sighting systems has long been established. When mounted parallel with the barrel of a firearm, lasers project a visible marker on a target which represents the intended impact point of the projectile. These laser sighting systems allow rapid target acquisition by indicating the projectile impact point with a visible mark.

SUMMARY

Generally, this invention relates to laser sighting system devices and methods for utilizing laser light sighting systems. The devices disclosed herein may be configured to be used with a variety of firearms or other devices that fire projectiles, which will be referred to collectively herein as firearms.

In one aspect, the invention features a device that includes a housing configured to be mounted in or on a firearm, and, disposed within the housing, a plurality of peripheral lasers positioned so as to project a pattern of light beams having an elongated geometric shape having an apex and a base, for example a pyramidal or conical shape.

Due to the shape of the pattern of light beams, the area of the pattern of dots that is projected onto a target by the beams increases with increasing distance between the target and firearm. In some implementations the increase in area is substantially representative of the perimeter of the affected area of one or more projectiles fired from the firearm.

Some implementations include one or more of the following features. The device may be configured with at least four peripheral lasers, which may in some cases include colored lasers, e.g., green lasers. The device may also include a central target laser, configured to sight the approximate center of the pyramidal pattern. The central target laser may be a colored laser, e.g., a red laser.

Some embodiments further include a plurality of LED lights configured to provide flashlight functionality, which may be white LEDs and which may be configured to operate in a strobe and/or a continuous mode. In some embodiments, the LED lights have a lumen output of at least 500 lumens.

In some embodiments, the housing includes bores configured to receive a barrel and muzzle of the firearm. Alternatively, the housing may be configured to be mounted on a picatinny or Weaver style rail system or other rail system provided on the firearm.

To provide the desired beam pattern, generally each of the peripheral lasers is mounted at an angle, which can be measured as will be described below. In some cases, each of the peripheral lasers is mounted at an angle of from about 0.01 to 10 degrees with respect to a longitudinal axis of the housing and an angle of from about 0.01 to 10 degrees with respect to a lateral axis of the housing. In some embodiments, each of the peripheral lasers is mounted at an angle of from about 0.2 to 2 degrees with respect to a longitudinal axis of the housing and at an angle of from about 0.2 to 2 degrees with respect to a lateral axis of the housing.

In some cases, the device is configured with an adjustment device that allows adjustment of the central target laser in the vertical and horizontal plane. Some embodiments include an adjustment device that allows adjustment of the peripheral lasers in the vertical and horizontal plane.

In another aspect, the invention features a method comprising mounting, in or on a firearm, a laser sighting system that includes a housing configured to be mounted on the firearm, and, disposed within the housing, a plurality of peripheral lasers positioned so as to project a pattern of light beams having an elongated geometric shape having an apex and a base, for example a pyramidal or conical shape, and using the pattern of light beams to determine the perimeter of the affected area of one or more projectiles fired from the firearm.

In some implementations, the method further includes a central laser, and the method includes using light from the central laser to determine the approximate center of the affected area. This aspect of the invention may include any one or more of the features discussed above with regard to the first aspect of the invention.

DETAILED DESCRIPTION

The laser sighting devices described herein provide a perimeter pattern on a target, by utilizing a group of lasers. The perimeter sighting is representative of the spread pattern that will occur when multiple projectiles are fired simultaneously from the firearm (e.g., a shotgun) on which the laser-sighting device is mounted or installed. Accordingly, because the field of the projectiles' spread pattern increases with distance, the size of the perimeter pattern spread corresponds substantially with the same increase with distance. Mounting the lasers so their beams project at angles that achieve the desired increase in the pattern spread over distance provides this effect. The arrangement of the lasers, and other preferred features of the devices, will be discussed in detail below.

The laser sighting devices described herein generally include a housing that is configured to protect the lasers. The device can be configured to attach to a variety of firearms, e.g., by utilizing a picatinny or Weaver style rail (MIL-1913 rail or STANAG 2324 rail) or by configuring a housing to slide over the barrel of the firearm as will be discussed further below. The device is generally powered by a battery or group of batteries, e.g. lithium ion or lithium polymer, that are contained within the housing or located remotely on the firearm.

Figure 1:
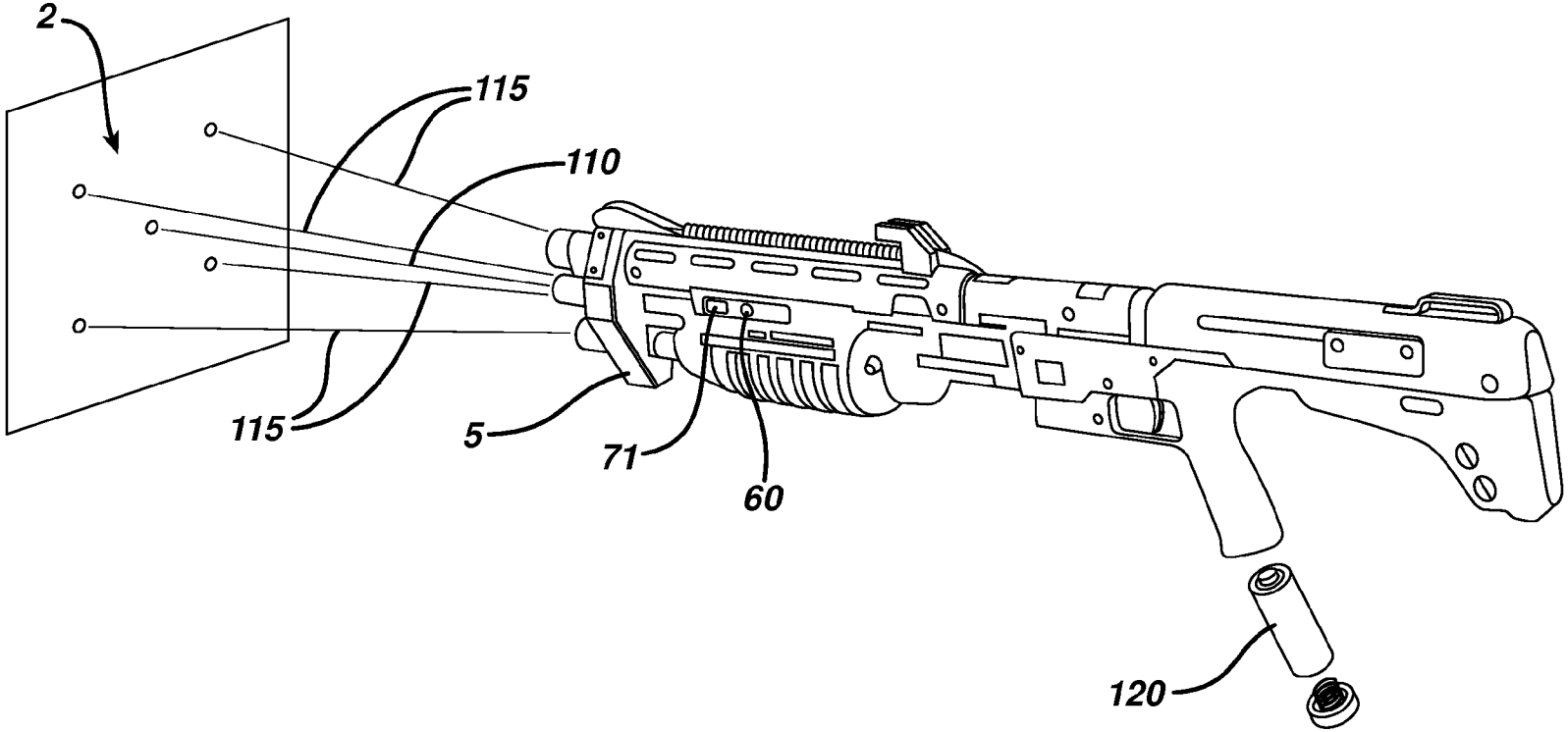
FIG. 1 is a side view of the device mounted on or integrated within the design of the firearm.
Figure 1A:
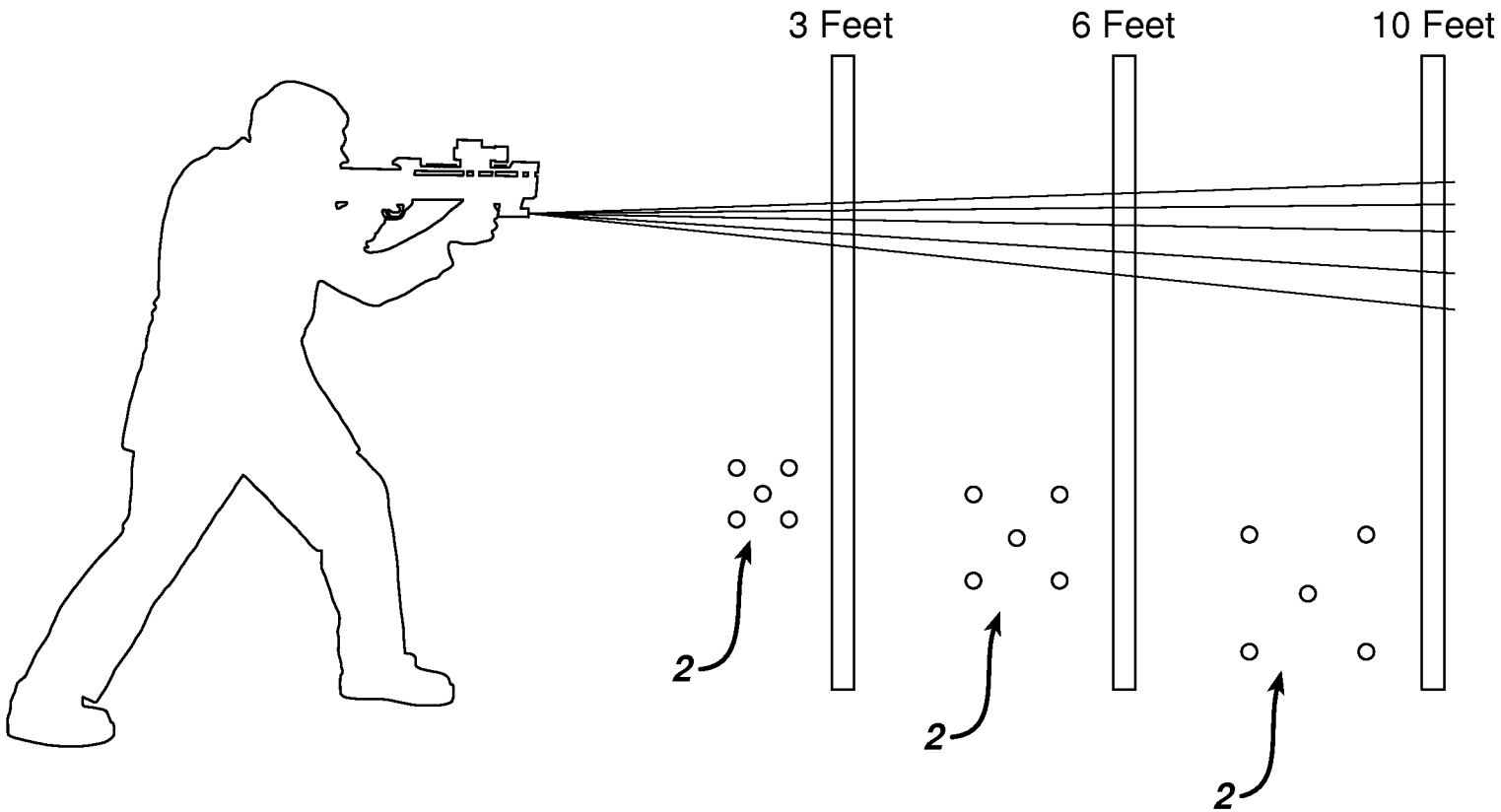
FIG. 1A is a laser pattern representation projected by the device.

Referring to FIG. 1, the device 5 is mounted on a firearm near the muzzle, to project a pattern of laser light, e.g., a geometric shape 2, on a target surface. This pattern is representative of the spread pattern that will occur when projectiles are fired from the firearm. The geometric shape may be, for example, a square, rectangle, circle, or oval. Because of the manner in which the lasers are mounted in the device, the beams of laser light that are projected from the device 5 define a generally pyramidal shape along their length. As a result, the size of the geometric shape 2 projected on the target increases with increasing distance from the firearm, as shown diagrammatically in FIG. 1A. This increase in size is representative of the increasing diameter of the sighting area with increasing distance between the firearm and the target.

Figure 2A:
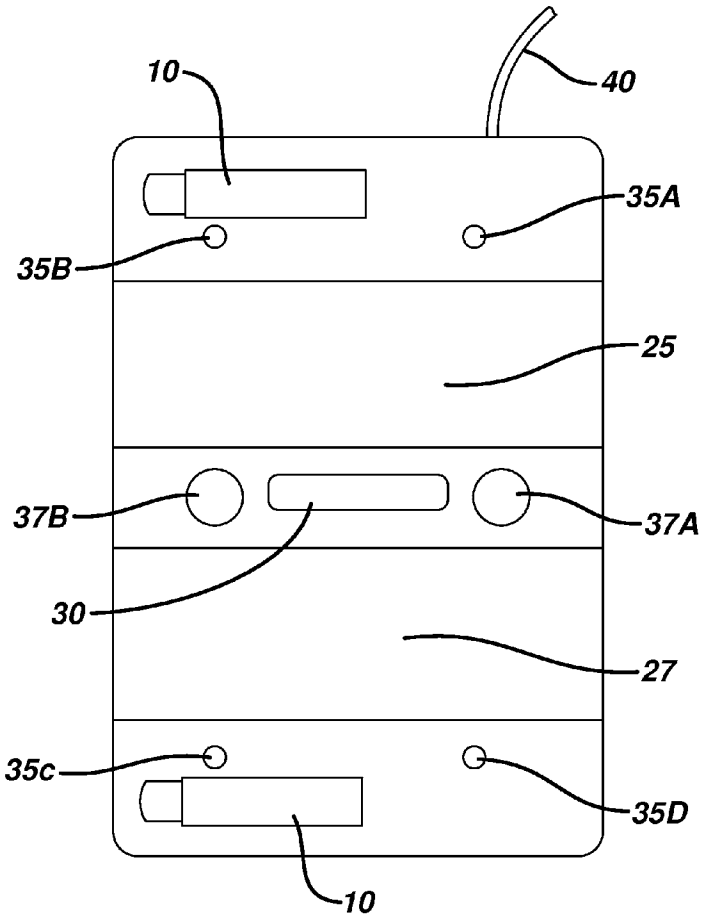
FIG. 2A is a side view of the barrel and magazine mounted device.
Figure 2:
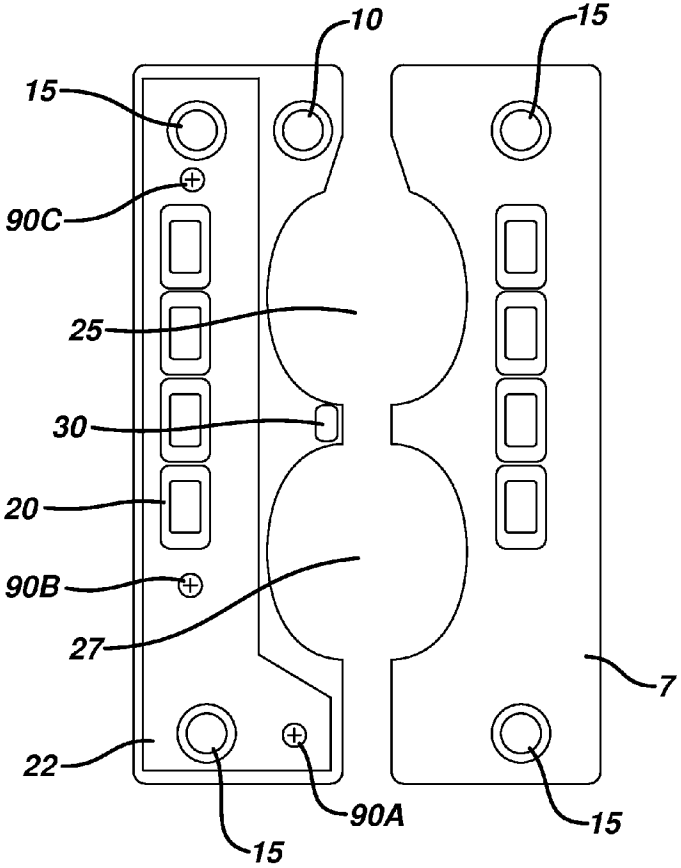
FIG. 2 is front view of the barrel and magazine mounted device.

Referring to FIG. 2, a device is shown that is configured to be mounted to or on a weapon (an example of device 5, shown in FIG. 1). The device includes a housing 10, green FLEXPOINT® 532 nm laser(s) 15 or equivalent and red laser(s) 10 positioned on the housing and mounted in bores that extend through the housing. The laser configuration creates a clean dot pattern 2 (FIG. 1) on the target surface that represents the perimeter (green lasers 15) and reference's the center (red lasers 10) of the impact zone of the projectiles. The lasers have a wavelength of about 650 nm, and a power output of about 3 to 7 mW.

Figure 1B:
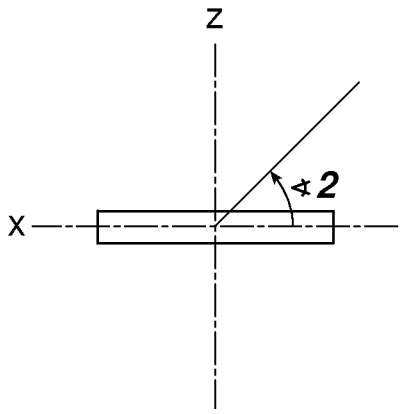
FIG. 1B is a side view of a laser representing an angle in the x-z plane.
Figure 1C:
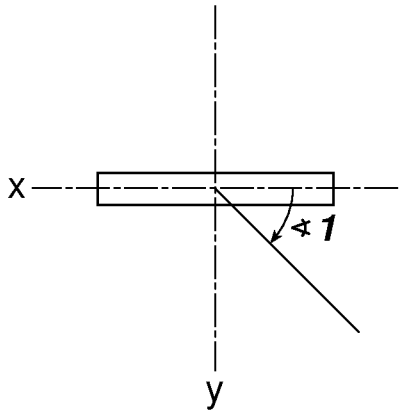
FIG. 1C is a top view of a laser representing an angle in the x-y plane.

As discussed above, the lasers are positioned at angles with respect to the longitudinal axis and lateral axis of the device. These angles are defined as shown in FIGS. 1B and 1C, which show a side view and a top view, respectively, of the laser. The angle with respect to the longitudinal axis (angle 2) is measured in the x-z plane, as shown in FIG. 1B, while the angle with respect to the lateral axis (angle 1) is measured in the x-y plane, as shown in FIG. 1C.

Figure 1D:
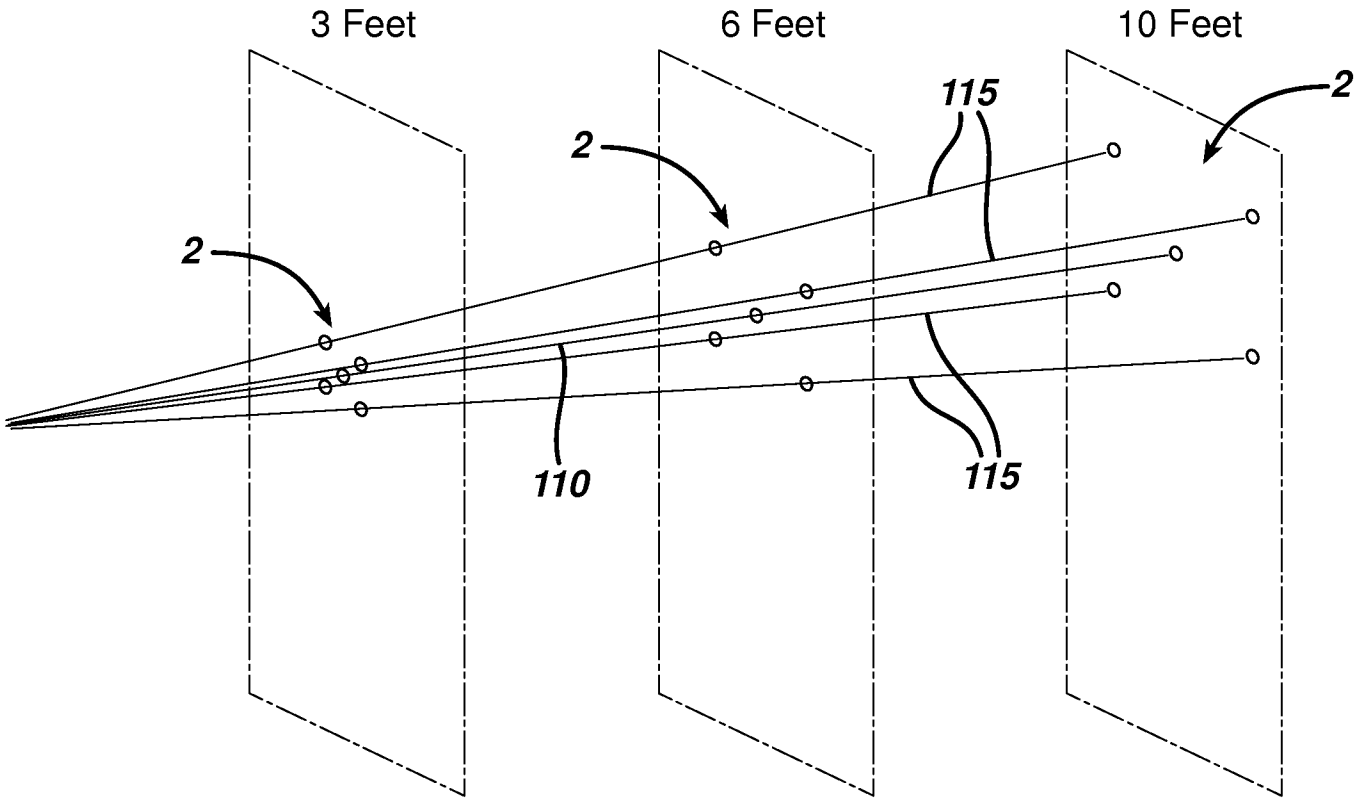
FIG. 1D is a diagrammatic view of the laser pattern projected by the device.

In some implementations, the lasers are set at an angle of 0.716° with regard to each of the longitudinal and lateral axes of the barrel of the firearm, but each of these angles could range from about 0.01° to 10°, for example from about 0.2° to 2°, depending on the length of the barrel and other factors. The angles of the lasers with respect to the lateral axis are substantially the same as the angles with respect to the longitudinal axis. This configuration produces the pyramidal beam configuration discussed above and thus the projected dot patterns (geometric shapes 2) shown in FIG. 1D, which have increasing size but the same shape with increasing distance between the target and the firearm.

The angle of the lasers is generally obtained by configuring the bores to extend through the housing at the desired angle with respect to the long axis of the housing. The 0.716° angle is calibrated for a standard tactical shotgun with an 18-20" barrel and standard choke, which is typical of what military and police use. When the lasers are mounted in a rectangle, as shown, the angles of the individual lasers will be adjustable to accommodate this shape.

In this implementation, the housing is configured to include central bores 25 and 27, which are configured to receive the barrel and magazine, respectively, of a firearm on which the device is to be mounted. The electrical connection 30 connects the green lasers 15, and red laser(s) 10 and the LEDs 20 to the selector switch 60 (FIG. 5) via the electrical lead 40. The electrical lead 40, in addition, connects the selector switch 60 to a power source 120 (FIG. 1). The large screw holes 37A, 37B allow the device 5 to be securely attached to the shotgun. The small screw holes 35A, 35B, 35C, and 35D aid in installation, positioning the device, and securing the device to prevent damage from the recoil of the weapon. Screws 90A, 90B, 90C secure the strobe/light circuit board 22 to the housing 7. The effective tactical range in this implementation is 30 feet, but could range from 2 to 1,000 feet depending on the projectile, cartridge load, and weapon.

Figure 3:
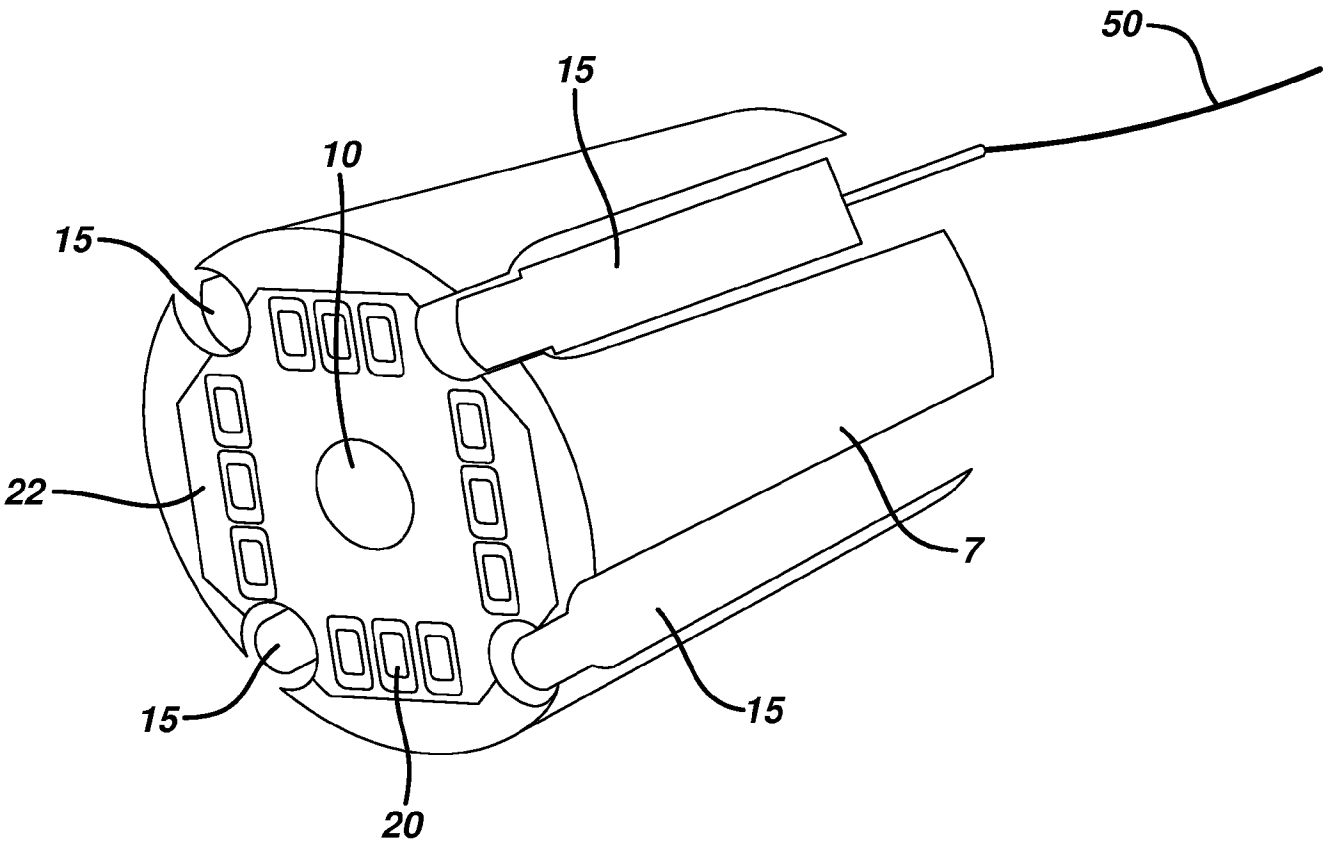
FIG. 3 is a plan view of a picatinny or Weaver style rail mounting of the device.

Referring to FIGS. 2 and 3, the device also includes a red laser light module 10 that is configured to illuminate the target surface generally in the middle of the pattern 2. Preferably, the red laser used is a FLEXPOINT® or equivalent Dot laser having a wavelength of from about 635 nm to 905 nm, and a power output of about 3 to 7 mW. The red laser light is intended to highlight the center impact point of the projectiles fired. Additionally, all the laser lights enable quick target acquisition.

Figure 3A:
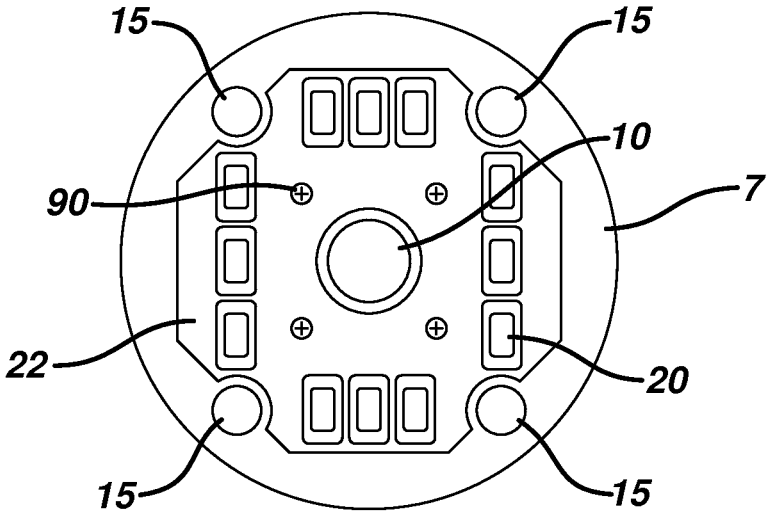
FIG. 3A is a front view of the alternative form of the device.

The devices may also, optionally, be configured to function as a flashlight. Referring to FIGS. 2, 3, and 3A, a plurality of super white LEDs 20, e.g., 7 to 11 LEDs, are arranged vertically and horizontally to fit within the housing, but can be mounted in many alternative configurations based on the intended application. These super white LEDs are preferably very bright, to provide good lighting in darkened areas, and so that they may be used to temporarily blind or distract an approaching attacker. Preferably the super white LEDs 20 are CREE XP-G R5, but could also be CREE XPGWHT-L1-2S0-R5 or be equivalent or similar, and have a lumen output of at least 500 lumens, e.g., may range in lumen output of 550 to 1953 lumens. While the number of LEDs used is preferably 9, it could range from 1 to 18. The super white LEDs 20 are configured to provide distinct modes of illumination, e.g. low, medium, high and a strobe effect. The distinct modes of illumination would be helpful for police or military forces when entering darkened rooms or enclosures. The strobe effect serves as a non-lethal option for gaining compliance and situational control.

Referring to FIGS. 3 and 3A, the housing 7 may have a different configuration, which may be designed to augment or facilitate the design and function of the weapon. For example, the housing 7 may be generally cylindrical, as shown, with a central bore for the red laser 10 and channels around the periphery for the outer, green lasers 15.

Figure 5:
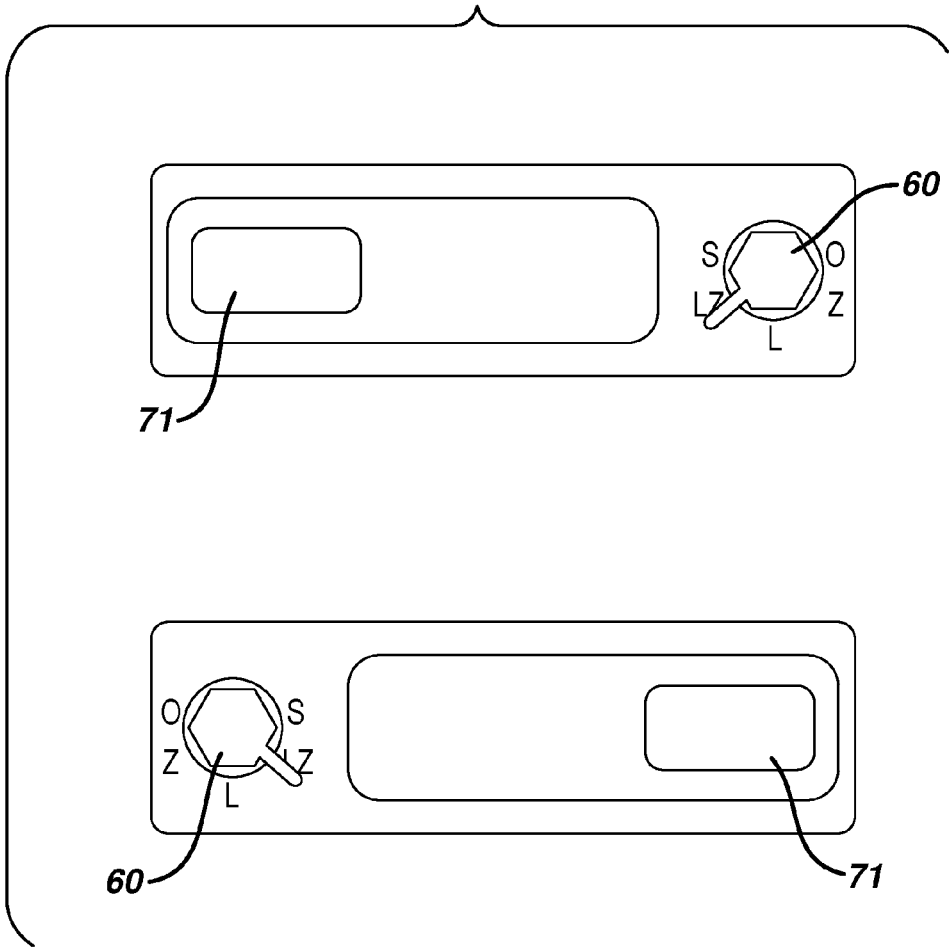
FIG. 5 is a view of the selector switch.

Referring to FIG. 5, the illumination modes are controlled by a laser/light/strobe selector switch 60. The selector switch allows the user to choose the illumination mode and laser function in one location. The device 5 is configured to have an on/off switch 71 located conveniently so that minimal hand movement is needed to activate or deactivate the device. The on/off switch 71 can be configured as an end cap, push on/off switch 76 (FIG. 6) or as a pressure-activated switch 72 that can be remotely located on another aspect of the firearm, e.g. the foregrip, stock, etc, or a combination thereof.

Figure 6:
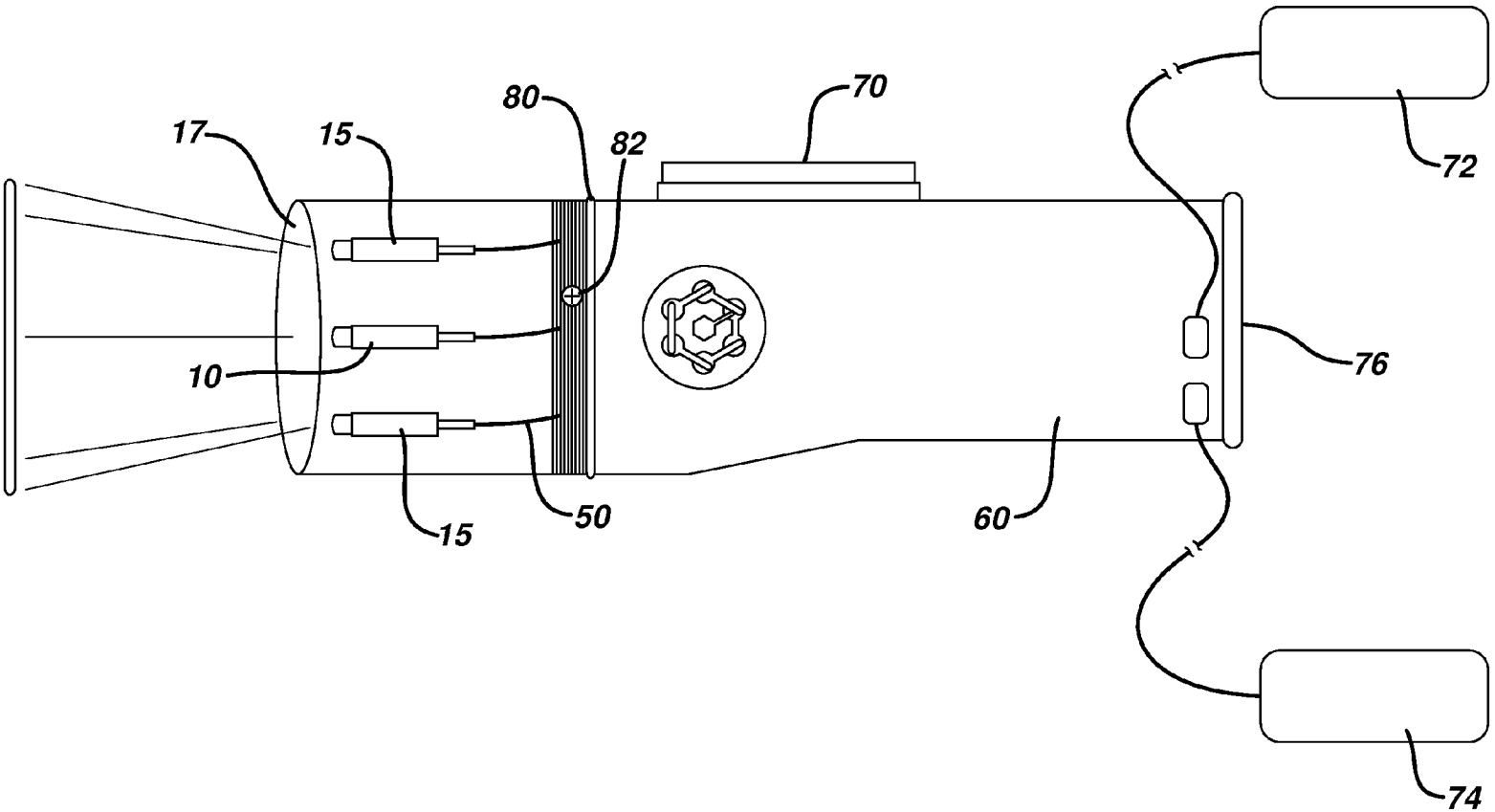
FIG. 6 is side view of basic fixed angle unit utilizing a picatinny rail or Weaver style mount connection
Figure 6A:
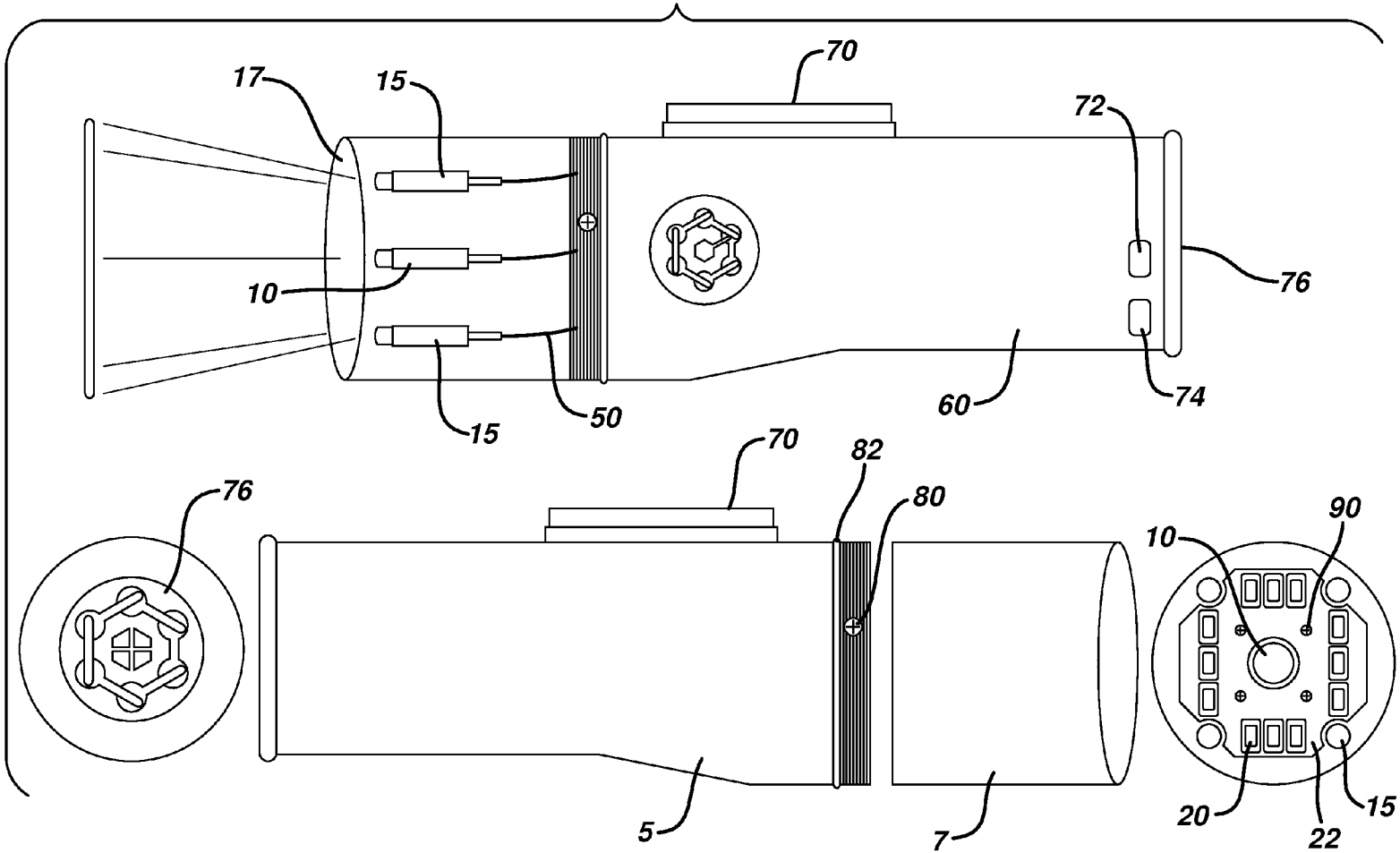
FIG. 6A is an additional side view of the basic fixed angle unit utilizing a picatinny or weaver style rail mount connection.
Figure 7:
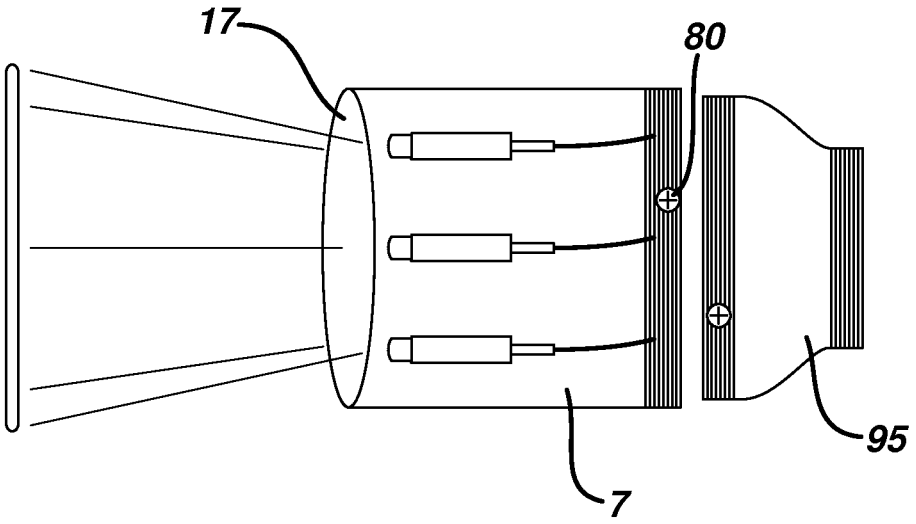
FIG. 7 is a side view of a fixed angle unit with an adapter.

Referring to FIG. 6, some embodiments may be configured to have two pressure-activated switches 72, 74 that control different modes of the device. For example, one pressure-activated switch could be configured to activate/deactivate the lasers with illumination while a second switch could be configured to activate/deactivate the lasers with strobe illumination. Pressure-activated switches are well known in the art.

Figure 4A:
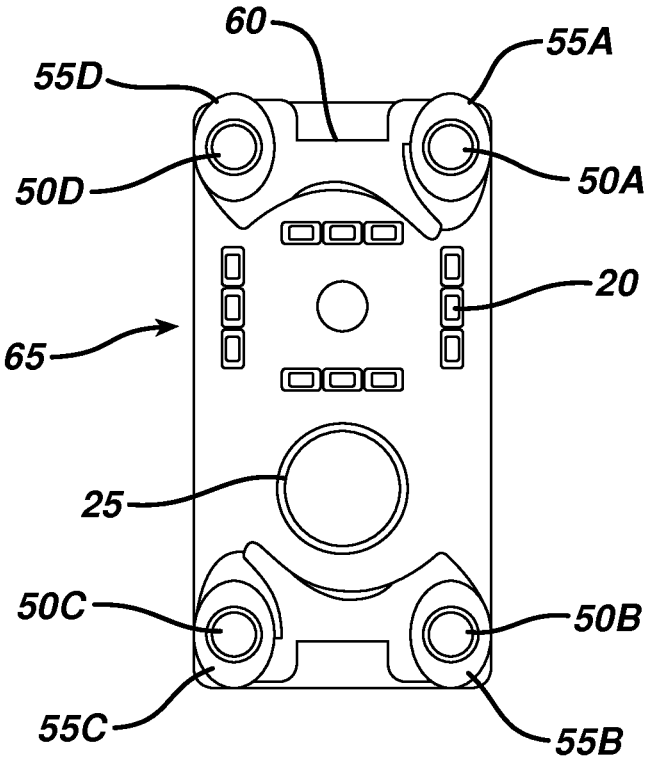
FIG. 4A is a front view of a variant of the device with vertical and horizontal adjustment capabilities.
Figure 4B:
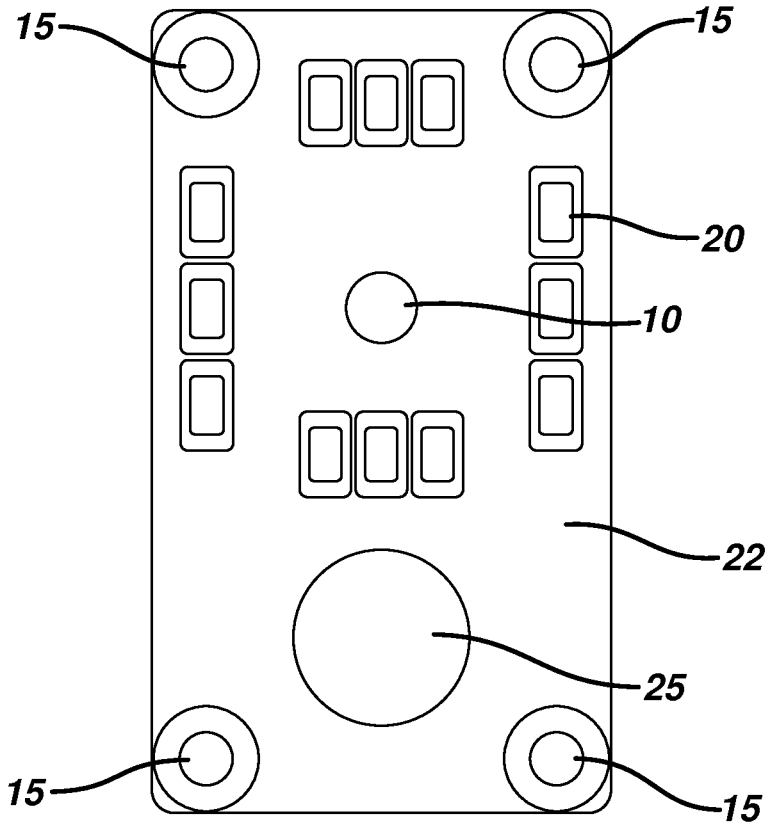
FIG. 4B is a front view of an alternative variant with fixed laser positions.

Referring to FIGS. 4A and 4B, the device can be configured with adjustment controls 50A-D and 55A-D that allow for independent vertical and horizontal adjustment of each of the lasers. Preferably by using a simple setscrew adjustment, or, for the more complex models, by using a miniature high precision hex adjustment screw with side lock. For example, the AJS8-100-02H Miniature Adjustment Screw has precision rolled threads for exceptionally smooth adjustment. The precision travel can be obtained with hex-head adjustment. This configuration would allow the device to be calibrated for a specific firearm, barrel, projectile, cartridge load, tactical range, and atmospheric conditions.

Referring to FIG. 6, a lens 17 is positioned to protect the laser lights and LEDs from atmospheric and foreign contaminants. Preferably, the lens would be constructed of a translucent polycarbonate or similar. In some cases, the lens may be selected to provide additional functionality to the device. For example, the lens may be formed of a material that only allows the light projected through the lens to be seen by persons wearing corresponding eyewear.

Referring to FIG. 1, the device 5 is powered by batteries or a battery pack. The power source 120 could be contained within the device or mounted in a remote location on the firearm, e.g. in the stock or grip of the firearm.

Figure 8:
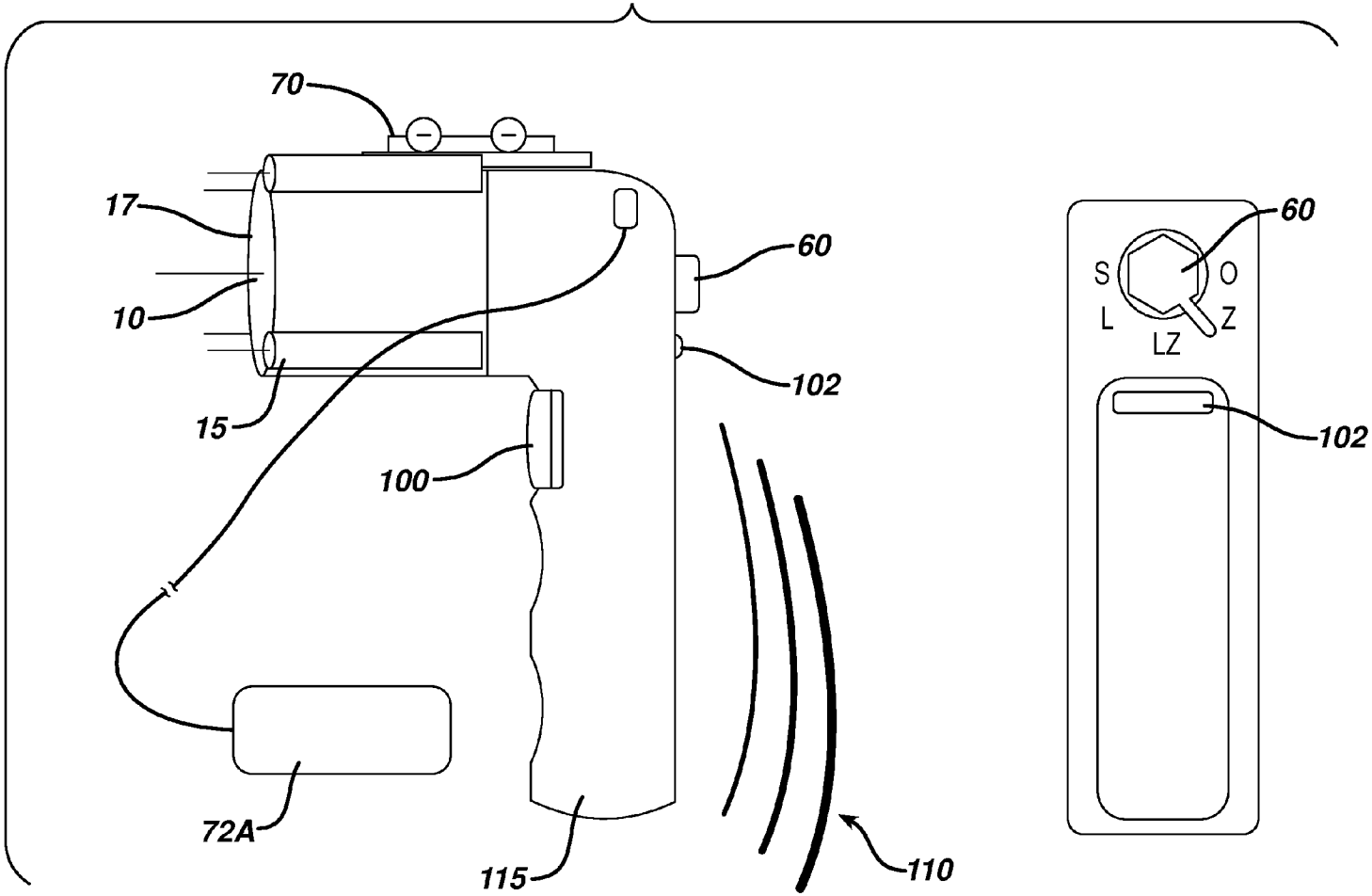
FIG. 8 is a side view of a device mounted to a "post" grip utilizing a picatinny or Weaver style rail mount connection.

Referring to FIG. 8, some embodiments may be configured as a post grip that designed to attach to a firearm by a picatinny rail 70. As discussed above, the lasers are positioned at angles with respect to the long axis of the device. The selector switch 60 is located so that the laser/light/strobe modes can be selected ambidextrously. Likewise, the trigger on/off switch 100 and the secondary on/off switch 102 are located so that successful operation can be achieved ambidextrously, requiring minimal movement of only the digits, e.g. the index finger and thumb. As discussed above, the post grip embodiment can be configured with one or more remote, pressure-actuated switches 72. The grip back strap 110 is configured to be interchangeable so that grip diameter can be customized accounting for differences in hand size and thereby increasing user comfort, performance and safety.

Other Embodiments

A number of embodiments have been described. Nevertheless, it will be understood that various modifications may be made without departing from the spirit and scope of the disclosure.

For example, one embodiment would feature a series of vertically aligned laser lights where each laser could be calibrated through individual adjustment to account for projectile trajectory at different distances. Forces, such as friction, gravitation, the Coriolis effect, etc., affect projectile trajectory and make it necessary for the user to account for these influences to ensure accuracy and precision. This feature would enable quick acquisition of the target at various ranges and seamlessly adjust the firearm angle with respect to the horizon. The user would simply align the appropriate laser dot calibrated for the distance to the target, thereby adjusting the angle of the barrel with respect to horizon. This feature would allow for the device to be calibrated for different firearms, projectile types, projectile loads, etc. A further alternative to this embodiment would be the use of multiple colors of lasers to better distinguish calibrated distances where a specific color laser would represent a different calibrated distance.

Also, while four outer lasers are shown in the figures and discussed above, the device could include more lasers if desired, e.g., from four to 20 outer lasers. Fewer lasers (e.g., four to eight) provide a less distracting pattern, while more lasers can be used with firearms having a very large projectile pattern spread or affected area. It is noted that if more lasers are used the geometric shape of the beam pattern defined by the laser beams may be other than pyramidal, e.g., conical or of a different cross-sectional shape.

Accordingly, other embodiments are within the scope of the following claims.

What is claimed is:

1. A device comprising:

a housing configured to be mounted in or on a firearm, and, disposed within the housing, a plurality of peripheral lasers mounted at an angle with respect to both a longitudinal and a lateral axis of the housing so as to project a pattern of light beams having an elongated geometric shape having an apex and a base, such that the spacing between dots that are projected in a pattern onto a target by the beams increases with increasing distance between the target and firearm, and the increase in area is substantially representative of the perimeter of affected area of one or more projectile(s) fired from the firearm.

2. The device of claim 1 wherein the shape is generally pyramidal or conical.

3. The device of claim 1 comprising at least four peripheral lasers.

4. The device of claim 1 wherein the peripheral lasers include colored lasers.

5. The device of claim 4 wherein the colored lasers include green lasers.

6. The device of claim 1 further comprising a central target laser, configured to sight the approximate center of the pattern.

7. The device of claim 6 wherein the central target laser is a colored laser.

8. The device of claim 7 wherein the central target laser is a red laser.

9. The device of claim 1 further comprising a plurality of LED lights configured to provide flashlight functionality.

10. The device of claim 1 wherein the housing includes bores configured to receive a barrel and muzzle of the firearm.

11. The device of claim 1 wherein the housing is configured to be mounted on a picatinny or Weaver style rail system.

12. The device of claim 1 wherein each of the peripheral lasers is mounted at an angle of from 0.01 to about 10 degrees with respect to a longitudinal axis of the housing and at an angle of from 0.01 to about 10 degrees with respect to a lateral axis of the housing.

13. The device of claim 12 wherein each of the peripheral lasers is mounted at an angle of from 0.2 to about 2 degrees with respect to a longitudinal axis of the housing and at an angle of from 0.2 to about 2 degrees with respect to a lateral axis of the housing.

14. The device of claim 9 wherein the LED lights are white.

15. The device of claim 9 wherein the LED lights are configured to be operated in a strobe or continuous mode.

16. The device of claim 9 wherein the LED lights have a lumen output of at least 500 lumens.

17. The device of claim 1 further comprising an adjustment device that allows adjustment of the central target laser in the vertical and horizontal plane.

18. The device of claim 1 further comprising an adjustment device that allows adjustment of the peripheral lasers in the vertical and horizontal plane.

19. A method comprising:

mounting, in or on a firearm, a laser sighting system that includes a housing configured to be mounted on the firearm, and, disposed within the housing, a plurality of peripheral lasers mounted at an angle with respect to both a longitudinal and a lateral axis of the housing so as to project a pattern of light beams having an elongated geometric shape having an apex and a base, such that the spacing between dots that are projected in a pattern onto a target by the beams increases with increasing distance between the target and firearm, and using the pattern to determine the perimeter of affected area of one or more projectiles fired from the firearm.

20. A device comprising:

a housing configured to be mounted in or on a firearm, and, disposed within the housing, a plurality of peripheral lasers positioned so as to project a pattern of light beams having an elongated geometric shape having an apex and a base, wherein each of the peripheral lasers is mounted at an angle of from 0.01 to about 10 degrees with respect to a longitudinal axis of the housing and at an angle of from 0.01 to about 10 degrees with respect to a lateral axis of the housing.

* * * * *